US009900933B2

(12) United States Patent
Jeanneteau et al.

(10) Patent No.: US 9,900,933 B2
(45) Date of Patent: Feb. 20, 2018

(54) HOB AND METHODS FOR OPERATING SUCH A HOB

(71) Applicant: Electrolux Appliances Aktiebolag, Stockholm (SE)

(72) Inventors: Laurent Jeanneteau, Forli (IT); Svend Erik Christiansen, Forli (IT); Andrea Rossi, Forli (IT); Alex Viroli, Forli (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 122 days.

(21) Appl. No.: 14/770,554

(22) PCT Filed: Mar. 11, 2014

(86) PCT No.: PCT/EP2014/054682
§ 371 (c)(1),
(2) Date: Aug. 26, 2015

(87) PCT Pub. No.: WO2014/177311
PCT Pub. Date: Nov. 6, 2014

(65) Prior Publication Data

US 2016/0050720 A1 Feb. 18, 2016

(30) Foreign Application Priority Data

Apr. 30, 2013 (EP) ..... 13165973

(51) Int. Cl.
*H05B 3/68* (2006.01)
*H05B 1/02* (2006.01)
(Continued)

(52) U.S. Cl.
CPC ..... *H05B 6/062* (2013.01); *F24C 7/00* (2013.01); *F24C 7/083* (2013.01); *H05B 6/1209* (2013.01); *H05B 2213/05* (2013.01)

(58) Field of Classification Search
CPC ..... F24C 7/00; F24C 7/083; H05B 2213/05; H05B 6/062; H05B 6/1209
(Continued)

(56) References Cited

U.S. PATENT DOCUMENTS 5,243,172 A * 9/1993 Hazan ..... F24C 15/106 219/447.1
2002/0162730 A1 11/2002 Gremm
(Continued)

FOREIGN PATENT DOCUMENTS

DE 10 2009 001 934 A1 9/2010
EP 1344983 A2 9/2003
(Continued)

OTHER PUBLICATIONS

International Search Report for PCT/EP2014/054682 dated May 16, 2014.

*Primary Examiner* — Sang Y Paik
(74) *Attorney, Agent, or Firm* — Pearne & Gordon LLP

(57) ABSTRACT

A hob and methods for operating such a hob. The hob includes a cooking surface adapted to receive a number of pots. A user interface allows a user to select and adjust at least one parameter of a cooking zone associated to a pot while indicating the number of pots on the selected cooking zone and a pot detection unit to detect the presence and non-presence of pots on the cooking surface. The hob further includes a control unit that cooperates with the pot detection unit and the user interface to control the function of commands received through the user interface. The control unit can cause a selection of a certain cooking zone and provide a corresponding indication that the certain cooking zone is from now on selected, if temporal interruption of a presence of a pot on the certain cooking zone was detected.

14 Claims, 1 Drawing Sheet

(51) Int. Cl.

| | |
|---|---|
| ***H05B 6/06*** | (2006.01) |
| ***F24C 7/00*** | (2006.01) |
| ***H05B 6/12*** | (2006.01) |
| ***F24C 7/08*** | (2006.01) |

(58) Field of Classification Search
USPC ..... 219/443.1–468.2, 518
See application file for complete search history.

(56) References Cited

U.S. PATENT DOCUMENTS

| | | | | |
|---|---|---|---|---|
| 2004/0007566 | A1* | 1/2004 | Staebler | H05B 3/74 219/445.1 |
| 2013/0161317 | A1* | 6/2013 | Lee | H05B 6/062 219/620 |

FOREIGN PATENT DOCUMENTS

| | | | |
|---|---|---|---|
| EP | 2276322 | A1 | 1/2011 |
| FR | 2872258 | A1 | 12/2005 |
| WO | 2009049989 | A1 | 4/2009 |
| WO | 2012/136475 | A1 | 10/2012 |

* cited by examiner

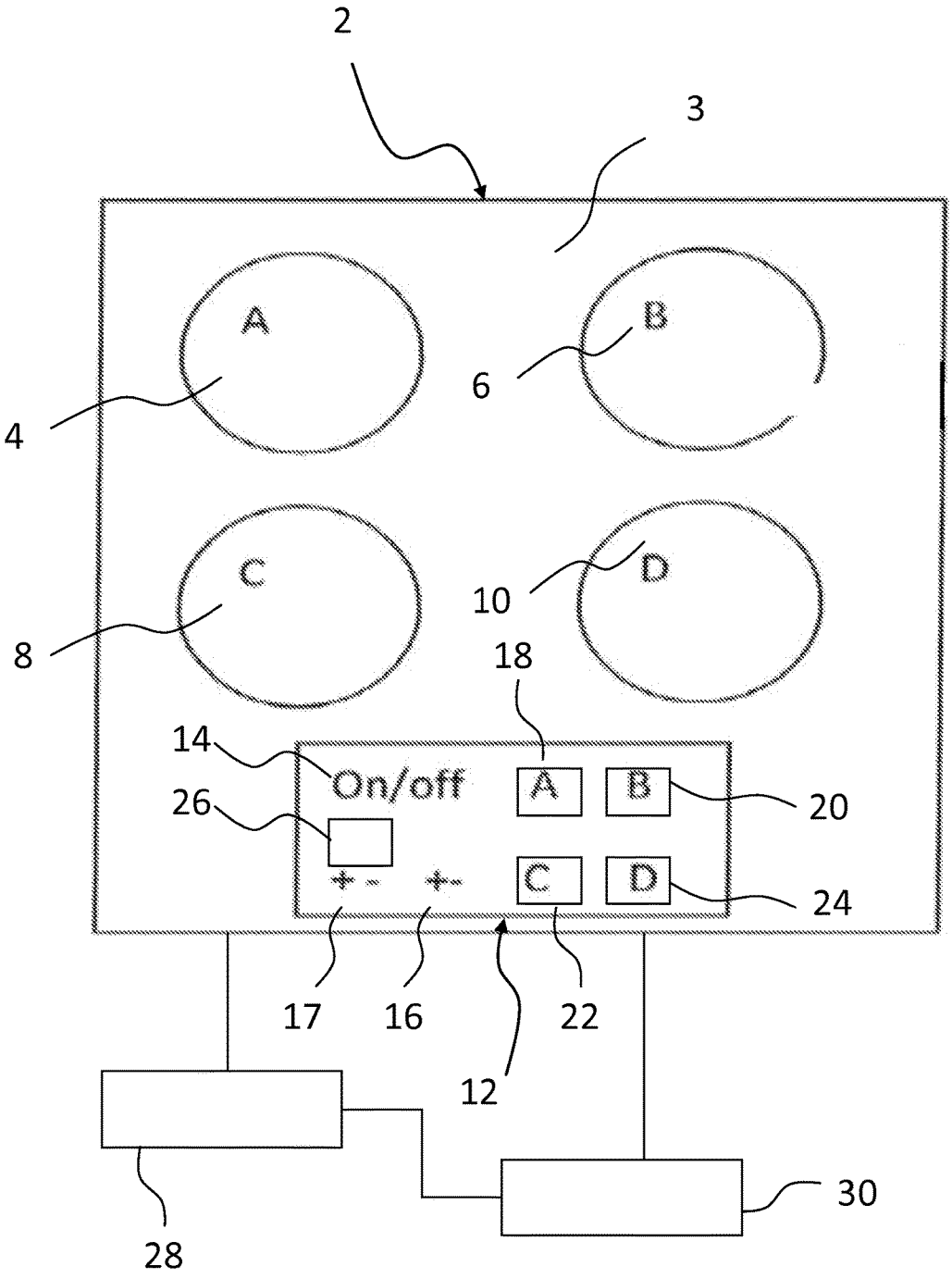
2
3
A
B
6
4
C
D
10
8
18
14
On/off
A
B
20
26
+ -
+-
C
D
24
17
16
22
12
28
30

HOB AND METHODS FOR OPERATING SUCH A HOB

The present application is directed to a hob and methods for operating such a hob.

BACKGROUND OF THE INVENTION

A lot of hobs, in particular electrical hobs are equipped with multiple cooking zones of predefined size and shape and a user interface for interaction, for example to switch on/off the hob or a cooking zone and to adjust the power of a cooking zone. For an user it is sometimes difficult to recognize immediately which operating element like a button or knob has to be adjusted to achieve the wanted function or setting of a parameter. So it can happen that the hob is operated wrongly by the user.

Moreover, hobs are known which can be operated by an user through moving of a pot on a cooking surface. The hob disclosed in DE 10 2011 102 394 A1 for example comprises an optical cookware recognition unit with which the orientation and position of a cookware placed on a cooking zone can be recorded. By changing of position and/or orientation of the cookware the user is able to adjust an operating parameter of the cooking zone on which the cookware is situated. On a display a direction for changing position and/or orientation to adjust the parameter and the actual value of the parameter are depicted. The aforementioned hob suffers from the drawback that an inadvertent movement or shifting of the cookware—which usually can happen if ingredients are poured into the cookware or the content of a cookware is stirred with a cooking spoon for example—can cause an unwished change of an operating parameter of a cooking zone.

From WO 2009/049989 A1 a cooking device is known wherein in one operation mode by shifting of a cookware from a first position into a second position on a cooking surface formed by heating units the heating parameter can be maintained, wherein in another operation mode by lifting a cookware from one position into another position the maintenance of the heating parameter has to be confirmed by the user through an user interface. The handling of this cooking device is very complicated. The user must differentiate between different kinds of movements, different kinds of use of input means in different operation modes which can easily lead to operating errors. Especially cooking with several pieces of cookware makes it more difficult to proper operate this kind of cooking device.

SUMMARY OF THE INVENTION

It is an object of the present invention to remove the problems and inconveniences observed with the state of the art. In particular a hob providing a more user friendly and intuitive handling and operation shall be provided. Especially a hob shall be provided which provides a reasonable balance between operating of the hob by interaction with pots and by an user interface.

This object is solved by claim 1 and claims 12 and 14. Embodiments in particular result from respective dependent claims.

According to claim 1, a hob is provided which comprises a cooking surface adapted to receive a number of pots, an user interface allowing an user to select a cooking zone associated to a pot and to adjust at least one operating parameter of the selected cooking zone, a pot detection unit adapted to detect the presence and non-presence of pots on the cooking surface, a control unit cooperating with the pot detection unit and the user interface and adapted to control the function of commands received through the user interface, wherein the user interface is adapted to indicate the user the presence of every pot of the number of pots on their associated cooking zones and to indicate the user the actually selected cooking zone whose at least one operating parameter is adjustable through the user interface by the user and wherein in one operation mode the control unit is adapted to cause a selection of a certain cooking zone and to provide a corresponding indication on the user interface that the certain cooking zone is from now on selected, if a corresponding signal from the pot detection unit was received by the control unit that a temporal interruption of a presence of a pot on the certain cooking zone was detected.

The term "pot" shall mean every kind of cookware which can be used for cooking on a hob and is suited to receive and cook food.

The term "cooking zone" shall mean predefined cooking areas on a cooking surface as well as variable-shape cooking areas, which in particular can be adapted to the shape and position of pots resting thereon.

The term "signal" shall mean a single signal or a sequence from signals which can be accordingly processed by a control unit.

The term "operating parameter" shall mean in particular a heat level, a setpoint temperature of a pot, a cooking time etc.

The invention is based on the recognition that with a pot detection unit a presence and non-presence of a pot on a cooking surface can be detected and corresponding signals or sequences of signals can be processed by a control unit accordingly.

Further on, the invention is based on the recognition that a control unit can be adapted to cause visual indications on a connected user interface which can facilitate orientation.

Moreover, the invention is based on the recognition that for most users it is very comfortable if an electric appliance can be operated by gestures.

The applicant has found that a handling of a hob is easily and intuitively for a user if interaction with the hob by gestures—like lifting movements, shifting movements or sliding movements of pots—as well as through a user interface is possible.

According to the invention the selection of a desired cooking zone is facilitated for the user. Because the proposed hob provides a control unit which is adapted to cause a selection of a certain cooking zone and to provide a corresponding indication on a user interface that the certain cooking zone is from now on selected, if a corresponding signal from the pot detection unit was received by the control unit that a temporal interruption of a presence of a pot on the certain cooking zone was detected, a user can simply select a desired cooking zone without being urged to think and decide which element of a user interface he has to operate. The user must only provide a temporal interruption of the presence of the pot on the cooking zone which he wants to select. This he can achieve easily by a kind of gesture, removing the pot from the desired cooking zone and placing it back again. As a consequence thereof the user can recognize on the user interface that the desired cooking zone is now selected. Thereby a mistakenly selection of a cooking zone and a following adjustment of an operating parameter of a wrong cooking zone can be avoided.

In embodiments of the hob the temporal interruption should comprise a duration of 1 to 10 seconds, preferably of 2 seconds. With such a time frame for the temporal interruption a reliable detection of a short interruption of a pot on its cooking zone is guaranteed and a corresponding indication of the selected cooking zone on the user interface can be ensured. In particular such time frame allows a reliable differentiation between a movement of the pot by which a selection shall be provided and other movements—for example a long-term removal required to add ingredients without the intention to select the corresponding cooking zone. Preferably the temporal interruption should not exceed two seconds. Hereby still a reliable detection of the temporal interruption is possible and a long-term cumbersome handling of a heavy pot, for example, is avoidable.

In embodiments of the hob, the hob is an induction hob, preferably an induction hob with a cooking surface comprising a working area with a full-area heating surface. Induction hobs are especially advantageous if a user interacts with the hob via moving or lifting pots because the danger of burnings of the user by unintentional touching of the cooking surface during such actions is avoidable. If additionally the cooking surface has a working area with a full-area heating surface the user has a great flexibility to arrange pots according to his wishes.

In embodiments of the hob, the user interface comprises a number of visual indication elements to indicate at least the actually selected cooking zone. By providing visual indication elements the user can easily recognize on first sight the selected cooking zone. The visual indication elements can comprise one or more LEDs for example, which can be operated in a blinking mode and/or a steady light mode.

In embodiments of the hob, the user interface comprises a number of confirmation elements corresponding to cooking zones through which a user can confirm the selection of a cooking zone. Thereby an unintentional selection of a wrong cooking zone is avoidable, the user has the possibility to make a targeted decision for a certain cooking zone. The confirmation elements can be touch keys, knobs or buttons for instance.

In embodiments of the hob, via the confirmation elements the user can not only confirm the selection of a cooking zone, but can confirm its release for adjustment of the at least one operating parameter, too. Hereby with only one touch, turn or click, for example, the user can conveniently continue directly to adjust an operating parameter of the cooking zone.

In embodiments of the hob, confirmation element and visual indication element are formed by one single element. Through this space can be saved and the clarity of the user interface can be increased. Furthermore, operating errors of the user can be avoided because the user need not assign a visual indication element to a corresponding confirmation element.

In embodiments of the hob, an operating element of the user interface for adjusting the at least one operating parameter of the selected cooking zone remains adjustable through the user interface as long as the control unit does not receive another command by a user through the user interface or a corresponding signal from the pot detection unit. Thereby the user can conveniently focus on the cooking process on this cooking zone without fearing that he has to affirm the selection of the cooking zone after a certain period of time again.

In embodiments of the hob, the control unit is adapted to copy a setting of the at least one operating parameter of a selected cooking zone to another cooking zone if through the pot detection unit a non-presence of a formerly detected pot on the selected cooking zone followed by a presence of said pot on the another cooking zone is detected within a predetermined period of time and a corresponding signal to the control unit is given. Thereby the for some users cumbersome interaction with the user interface can be effectively reduced. The user can simply move or lift the pot from the selected cooking zone within the predetermined period of time to the another cooking zone and then the control unit triggered by the pot detection unit can automatically copy the power setting from the one cooking zone to the another cooking zone. By this simple procedure even time can be saved.

In particular, the control unit is adapted to copy the setting of the operation parameter only after a confirmation command of an user through the user interface is given. Hereby an inadvertent copying of a setting of an operating parameter to another cooking zone can be avoided—for example, if the user only intended by a pot movement to change the cooking zones to have the possibility that the pot can cool down on the other cooking zone. Preferably, due to the movement of the pot the control unit provides a visual indication on the user interface that now the another cooking zone is selected. In particular, the confirmation that the power setting shall be copied can be provided via the confirmation element belonging to the another cooking zone.

In embodiments of the hob, in a further operation mode the control unit is adapted to assign a number of different levels of a setting of the at least one operating parameter of a selected cooking zone to a corresponding number of different cooking zones if through the pot detection unit a non-presence of a formerly detected pot on the selected cooking zone followed by a presence of said pot on another cooking zone is detected within a predetermined period of time and a corresponding signal to the control unit is given. This mode might be of interest for a user if he wants to cook a complicated dish where different steps of preparation require two or more different cooking temperatures, for example. The user may choose this operation mode through a mode selection switch of the user interface for instance. Through selection of this mode the control unit will be prepared to assign a predefined number of cooking zones different levels dependent on the setting of the at least one operating parameter of the selected cooking zone. That means if for example the control unit is prepared to assign each of two further cooking zones a different level of a setting of an operating parameter of a selected cooking zone and the setting of the operating parameter of the selected cooking zone was high, the control unit will be adapted to assign to one further cooking zone a medium level of the setting of this operating parameter and to the other cooking zone a low level of the setting of this operating parameter. If the setting of the operation of the selected cooking zone would have been low, the levels high and medium would have been assigned and so on. Assuming again that two further cooking zones shall be assigned a different level for instance, the control unit will be adapted to assign a different level of an operating parameter of the selected cooking zone in a first step to one of the two further cooking zones after a non-presence of the pot on the selected cooking zone followed by a presence of said pot on one of the further cooking zones was detected by the pot detection unit and to assign a further different level of the operating parameter of the originally selected cooking zone in a next step to the second further cooking zone after a non-presence of the pot on the first further cooking zone followed by a presence of the pot on the second further cooking zone was detected by the pot detection unit. This reasoning can be extended to any number of cooking zones.

In particular, the control unit is adapted to assign a different level of the setting of the at least one operating parameter only after a confirmation command of an user through the user interface is given. Hereby an inadvertent assigning of a different level of a setting of the at least one operating parameter to a not desired cooking zone can be avoided. Preferably, due to the movement of the pot the control unit provides a visual indication on the user interface that now the another cooking zone is selected. In particular, the confirmation that a different level of the setting of the at least one operating parameter shall be assigned can be provided via a confirmation element belonging to the another cooking zone. Thereby the user has the possibility to affirm the copying procedure or to cancel it.

In particular, the predetermined period of time with respect to the aforementioned copying procedure of a setting of an operating parameter and/or the aforementioned level gradient assigning procedure should comprise a duration of 1 to 10 seconds, preferably of 2 seconds. With such a time frame for the predetermined period of time a reliable detection of a non-presence of a formerly detected pot on a selected cooking zone followed by a detection of a presence of said pot on another cooking zone can be guaranteed. Further on, a corresponding indication on the user interface that now the another cooking zone is selected can be ensured. Preferably the predetermined period of time should not exceed two seconds. Hereby still a reliable detection of the non-presence of a formerly detected pot followed by a presence of said pot on another cooking zone is possible and a long-term cumbersome handling of a heavy pot, for example, is avoidable.

As can be seen, the hob, in particular in any embodiment allows user friendly handling and operation. The interaction with the user interface can be reduced through interaction with the hob via movements of a pot.

According to claim 12 a method for operating an embodiment of an aforementioned hob, wherein a user copies the setting of at least one operating parameter of one cooking zone associated to a pot to another cooking zone comprises at least the following steps a) adjusting an operating parameter of a selected cooking zone, b) placing the pot from the selected cooking zone to another cooking zone within a predetermined period of time, c) confirmation of copying the setting of the operating parameter to the another cooking zone by operating of a corresponding confirmation element by the user interface.

As to advantages, reference is made to the description above.

Before step a) the steps placing a pot on the cooking surface of the hob, confirmation of the selection of the indicated selected cooking zone on the user interface through operating of an corresponding confirmation element of the user interface or the steps removing a pot from a cooking zone and moving it back to this cooking zone within a certain time frame, confirmation of the selection of the indicated selected cooking zone on the user interface through operating of an corresponding confirmation element of the user interface might be provided if not already a cooking zone whose at least one operating parameter should be copied was selected by the user. In the last variant step a) could be omitted if the setting of the to copying operating parameter is already adjusted to the desired value.

After the steps a)-c) the steps d) moving the pot from the another cooking zone to the originally selected cooking zone, e) adding a further pot to the another cooking zone might be added. The user may now proceed with cooking with two cooking zones providing at least one identical operating parameter or he may repeat the procedure to copy the setting of the operating parameter to a further cooking zone.

According to claim 14 a method for operating an embodiment of an aforementioned hob, wherein a user assigns a number of different levels of a setting of an operating parameter of a cooking zone to a corresponding number of different cooking zones comprises at least the following steps a) selecting an operation mode which allows to assign different levels of a setting of an operating parameter of a cooking zone to different cooking zones of the hob through the user interface, b) adjusting an operating parameter of a selected cooking zone associated to a pot through the user interface, c) placing the pot from the selected cooking zone to another cooking zone within a predetermined period of time, d) confirmation of assigning a different level of a setting of the operating parameter to the another cooking zone by operating of a corresponding confirmation element of the user interface. As to advantages, reference is made to the description above.

Before step b) the steps placing a pot on the cooking surface of the hob, confirmation of the selection of the indicated selected cooking zone on the user interface through operating of a corresponding confirmation element of the user interface or the steps removing a pot from a cooking zone and moving it back to this cooking zone within a certain time frame, confirmation of the selection of the indicated selected cooking zone on the user interface through operating of a corresponding confirmation element of the user interface might be provided if not already a cooking zone whose operating parameter shall serve as reference for assigning different levels was selected by the user. In the last variant step b) could be omitted if the setting of the operating parameter is already adjusted to the desired value.

Furthermore, the chronological order of steps a) and b) could be switched.

After the steps a)-d) the step e) repeating of steps c) and d) to assign one further or more cooking zones another different level of the setting of the operating parameter of the original cooking zone might be added if more than one further cooking zone should be assigned a different level of the operating parameter of the originally selected cooking zone.

As to advantages and advantageous effects of the hob and the methods to operate such a hob further reference is made to the description above and below.

Preferred embodiments of the invention will now be described in connection with the enclosed FIGURE which shows a schematic top view on a cooking surface of a hob.

Note, that the hob will be described only as far as is necessary for covering the invention.

BRIEF DESCRIPTION OF THE DRAWING

The only FIGURE shows a schematic top view on a cooking surface 3 of a hob 2. The hob 2 is an induction hob and provides four cooking zones 4, 6, 8 and 10 on its cooking surface 3.

DETAILED DESCRIPTION OF THE INVENTION

Further on, the hob 2 is equipped with an user interface 12 with touch keys and visual indications. The user interface 12 provides a main switch 14 for turning on and off the hob 2, an "+/−" operating element 16 for adjusting the power settings of the cooking zones 4, 6, 8, 10, an "+/−" operating element 17 for adjusting a switch off timer of the cooking zones 4, 6, 8, 10, confirmation elements 18, 20, 22, 24 belonging to the corresponding cooking zones 4, 6, 8, 10 for selecting and releasing a cooking zone 4, 6, 8, 10 for adjustment by operating elements 16 and 17 and an operation mode selection switch 26. The aforementioned switches 14, 26, operating elements 16, 17 and confirmation elements 18, 20, 22, 24 are all provided in form of easy useable touch keys. Moreover, the confirmation elements 18, 20, 22, 24 provide associated visual indication elements A, B, C, D, for example LEDs, which can blink or light continuously.

Only schematically depicted are a pot detection unit 28 and a control unit 30 which are usually integrated in the hob 2. The pot detection unit 28 can be part of the control unit 30 and is in signalling connection with the control unit 30, represented by the connection line in the FIGURE. The control unit 30 is prepared to receive signals form the pot detection unit 28 and to provide dependent from the signals from the pot detection unit 28 a selection of a cooking zone 4, 6, 8, 10 and a corresponding indication on the user interface 12; especially the control unit 30 can cause a blinking modus of a visual indication element A, B, C, D of a confirmation element 18, 20, 22, 24 of a corresponding cooking zone 4, 6, 8, 10 directly after a pot was detected by the pot detection unit 28 on this cooking zone 4, 6, 8, 10 and besides the control unit 30 can cause a blinking modus of a visual indication element A, B, C, D of a confirmation element 18, 20, 22, 24 belonging to a certain cooking zone 4, 6, 8, 10 if a temporal interruption of a presence of a pot on this certain cooking zone 4, 6, 8, 10 was detected by the pot detection unit 28 and the control unit 30 can cause a blinking modus of a visual indication element A, B, C, D of a confirmation element 18, 20, 22, 24 if a non-presence of a pot on a selected cooking zone 4, 6, 8, 10 followed by a presence of said pot on another cooking zone 4, 6, 8, 10 within a predetermined period of time was detected by the pot detection unit 28. This temporal interruption or this predetermined period of time should not exceed a duration of two seconds. With such a time frame for the temporal interruption a reliable detection of a short interruption of the presence of a pot on its associated cooking zone 4, 6, 8, 10 is ensured which shall cause a selection and indication of this cooking zone 4, 6, 8, 10 and can be distinguished from other removing and moving back processes of the pot by the user (for example, if the user removes the pot from the hob 2 to add ingredients and places the pot back again on its cooking zone 4, 6, 8, 10) by which no signal from the pot detection unit 28 to the control unit 30 and no selection and indication of the cooking zone 4, 6, 8, 10 shall be provided. The same applies analogously for the predetermined period of time: With such a time frame for the predetermined period of time the selection of another cooking zone 4, 6, 8, 10 by moving a pot from a selected cooking zone 4, 6, 8, 10 to another cooking zone 4, 6, 8, 10 can reliably detected by the pot detection unit 28 and can be distinguished from other interaction with pots which shall not cause a selection and indication of another cooking zone 4, 6, 8, 10. Therefore the pot detection unit 28 is prepared to provide only a corresponding signal to the control unit 30 to provide a selection of a cooking zone 4, 6, 8, 10 and a corresponding indication on the user interface if a time period of two seconds was not exceeded. Furthermore, the control unit 30 is adapted to process the commands received by a user through the user interface 12 in known manner.

The hob 2 and its different modes of operation are now described step by step including the steps which a user has to do to operate the hob 2 in different operation modes and the corresponding internal processes within the hob 2 with respect to the pot detection unit 28 and the control unit 30.

In a normal operation mode the user turns on the hob 2 by the main switch 14 of the user interface 12 in a first step. Hereby pot detection unit 28 and control unit 30 are activated. Then user places a pot on the cooking surface 3, whereby in case of a hob 2 with predefined cooking zones 4, 6, 8, 10 user has to put the pot on such a predefined zone, but in case of a hob 2 with a cooking surface 3 providing a working area with full area-heating surface the user can put the pot on any place of the working area to be detected by an according pot detection unit 28. Due to detection of a pot through the pot detection unit 28 the control unit 30 provides a corresponding indication on the user interface 12. If the user placed the pot on cooking zone 4, for example, the control unit 30 will cause a blinking mode of the visual indication element A of confirmation element 18 which belongs to cooking zone 4. To be able to adjust the power setting of cooking zone 4 user has to confirm that this cooking zone 4 shall be actually selected or rather adjusted. This confirmation is effected by touching of the confirmation element 18 by the user. In this way an unintentional wrong operation can be avoided. The user can now adjust the power setting of cooking zone 4 by touching operating element 16. If the user requires a further pot for cooking he can place another pot on the cooking surface 3, for example on cooking zone 10. This further pot will be recognized by the pot detection unit 28, too, and the control unit 30 will cause a blinking mode of the visual indication element D of the confirmation element 24 which belongs to cooking zone 10. In the same manner with respect to the adjustment of the power setting of cooking zone 4 the user has now to confirm that the power setting of cooking zone 10 shall be adjusted by touching of confirmation element 24 which belongs to cooking zone 10, afterward an adjustment by touching operating element 16 is possible. The before described steps can be repeated with further pots on further cooking zones 6, 8 if required. By the respective blinking of visual indication element A, B, C, D of the confirmation element 18, 20, 22, 24 in consequence of detection of a pot and following confirmation by the user an operation of a wrong cooking zone 4, 6, 8, 10 can be avoided. Assuming the user wants to change now the power setting or the switch off timer of cooking zone 4 and is not sure, which touch key of the several touch keys corresponding to the different cooking zones 4, 6, 8, 10 on the user interface 12 he has to use, he has the following possibility: He can simply remove the pot from cooking zone 4—for example by a shifting or a lifting movement. Then user can put back the pot on cooking zone 4. This removal or rather temporal interruption of presence of the pot on cooking zone 4 is detected by the pot detection unit 28 and causes the control unit 30 to select cooking zone 4 and to prom vide a blinking mode of the visual indication element A of confirmation element 18 belonging to cooking zone 4. Hereby user can now easily recognize on the user interface 12 that the by him through the pot movement selected cooking zone 4 can be adjusted by operating elements 16 or 17 after touching the clearly indicated confirmation element 18. An erroneously operation of a wrong cooking zone 6, 8, 10 can be precluded. In this context it is mentioned, that the phase of non-presence of the pot on cooking zone 4 should not exceed the aforementioned time period of two seconds. The cooking zone 4 remains adjustable through the user by operating element 16 as long as the control unit 30 does not receive another command through the user interface or a corresponding signal form the pot detection unit 28.

The hob 2 also allows a simple procedure to copy a power setting from one cooking zone 4, 6, 8, 10 to another cooking zone 4, 6, 8, 10. The first steps are the same as described before, unless a desired cooking zone 4, 6, 8, 10 was already selected and adjusted by the user as mentioned before, for example:

If the hob 2 is "off" the user has to turn it on by main switch 14 of user interface 12. By placing a pot on cooking zone 4 for example, the cooperation of pot detection unit 28 and control unit 30 causes the visual indication element A of confirmation element 18 corresponding to cooking zone 4 to start blinking. By touching of the confirmation element 18 the user confirms that he wants to adjust the power setting of cooking zone 4. By corresponding operation of operation element 16 the user can then adjust the wanted power setting for cooking zone 4. If the user now intends to operate a further pot on another cooking zone, for example on cooking zone 6 he can simply move the pot associated to cooking zone 4 to cooking zone 6. This movement shall not exceed a time period of two seconds as stated previously. The pot detection unit 28 detects the non-presence of the pot on cooking zone 4 and the following presence of this pot on cooking zone 6. Because of a corresponding signal from the pot detection unit 28 to the control unit 30 the control unit 30 causes the visual indication element B of the confirmation element 20 of cooking zone 6 to start blinking. By touching the confirmation element 20 the user can simply confirm through the user interface 12 that the control unit 30 shall automatically copy the power setting of cooking zone 4 to cooking zone 6. Now the user can move the pot from cooking zone 6 back again to cooking zone 4 and put another pot on cooking zone 6 which will be heated as pot on cooking zone 4. If the moving back process of the pot again does not exceed two seconds the control unit 30 will based on a signal from the pot detection unit 28—provide a blinking modus of the visual indication element A of confirmation element 18 corresponding to cooking zone 4. By corresponding touching of confirmation element 18 the user can then adjust cooking zone 4 by operating elements 16 or 17 again if desired. Thus the user can copy in a quick and easy way the concrete power setting of cooking zone 4 to cooking zone 6 by a combination of interactions with the hob 2 by movements of a pot on the cooking surface 3 and simple confirmation and instruction inputs through the user interface 12. By this combination a quick and intuitive handling of the hob 2 is achieved.

Moreover, the hob 2 is adapted to be operated in a so-called "chef mode". If a user wants to prepare certain complicated dishes it would be advantageous if he could change quickly between different cooking temperatures. Especially it would be comfortable if the user could use different cooking zones 4, 6, 8, 10 providing a power gradient between each other so that he can use for one preparation phase of a dish a low temperature on one cooking zone 4, 6, 8, 10, for another phase a medium temperature on another cooking zone 4, 6, 8, 10 and for a further preparation phase a high temperature on a further cooking zone 4, 6, 8, 10, for example. The mentioned "chef mode" allows the user to assign different cooking zones 4, 6, 8, 10 different levels of a power setting with respect to the power setting of a "reference" cooking zone 4, 6, 8, 10 by simple interaction with the hob 2 by a pot and by commands inputted through the user interface 12 by the user. In this mode the control unit 30 is adapted to assign later selected cooking zones 4, 6, 8, 10 a power setting which is each different from the power setting from the first cooking zone 4, 6, 8, 10 without the user having to adjust every zone individually. An example of such a procedure will now be given:

If not already a desired cooking zone 4, 6, 8, 10 was selected and adjusted by the user in a manner as mentioned before, for example, user again has to turn on hob 2 by main switch 14 on the user interface 12 which provides activation of pot detection unit 28 and control unit 30. Before or after selection and adjustment of a cooking zone 4, 6, 8, 10 user has to choose special operation mode "chef-mode" by corresponding touching of operation mode selection switch 26. Exemplary assuming user has chosen "chef mode" after turning on of the hob 2 the user can now put a pot on cooking surface 3 of hob 2, for example on cooking zone 4. As described before by pot detection unit 28 in connection with control unit 30 the visual indication element A of confirmation element 18 of cooking zone 4 will start blinking and indicate the user that cooking zone 4 is released for adjustment if user touches confirmation element 18. After user has touched confirmation element 18 he can adjust in usual manner the power setting of cooking zone 4 by corresponding operation of operation element 16. Now user moves pot from the selected cooking zone 4 on cooking zone 6, for example, within a predetermined period of time. By the pot detection unit 28 it is recognized that a movement of this pot from the selected cooking zone 4 to the cooking zone 6 occurred or rather a non-presence of the pot on cooking zone 4 followed by a presence of that pot on cooking zone 6 is detected. As a result of this the control unit 30 receives a corresponding signal from the pot detection unit 28 and causes the visual indication element B belonging to confirmation element 20 of cooking zone 6 to start blinking. By touching the confirmation element 20 the user can simply confirm through the user interface 12 that the control unit 30 shall automatically assign cooking zone 6 a power setting that is at an intermediate level with respect to the power setting of cooking zone 4. After this step user can move the pot from cooking zone 6 to cooking zone 8, for example, within the aforementioned predetermined period of time. Thereby in known manner control unit 30 causes the visual indication element C belonging to confirmation element 22 of cooking zone 8 to start blinking. By touching the confirmation element 22 the user can simply confirm through the user interface 12 that the control unit 30 shall automatically assign cooking zone 8 a power setting that is at a low level with respect to the power setting of cooking zone 4. After performing this simple procedure the user can now move the pot among cooking zones 4, 6 and 8 and has three different temperatures at his disposal to prepare the dish. Assuming that the power of the cooking zones is adjustable in increments up to "14" and the power setting of cooking zone 4 in the aforementioned example was "12" following power gradient could have been automatically provided by the control unit 30: "6" for cooking zone 6 and "1" for cooking zone 8.

LIST OF REFERENCE NUMERALS

2 hob
3 cooking surface
4 cooking zone
6 cooking zone
8 cooking zone
10 cooking zone
12 user interface
14 on/off switch
16 operating element for adjusting the power settings of a cooking zone 4, 6, 8, 10
17 operating element for adjusting a switch off timer of a cooking zone 4, 6, 8, 10
18 confirmation element for cooking zone 4
20 confirmation element for cooking zone 6
22 confirmation element for cooking zone 8
24 confirmation element for cooking zone 10
26 operation mode selection switch
28 pot detection unit
30 control unit
A visual indication element
B visual indication element
C visual indication element
D visual indication element

What is claimed is:

1. Hob (2) comprising;

a cooking surface (3) adapted to receive a number of pots, an user interface (12) allowing an user to select a cooking zone (4, 6, 8, 10) associated to a pot and to adjust at least one operating parameter of the selected cooking zone (4, 6, 8, 10), a pot detection unit (28) adapted to detect the presence and non-presence of pots on the cooking surface (3), a control unit (30) cooperating with the pot detection unit (28) and the user interface (12) and adapted to control the function of commands received through the user interface (12), wherein the user interface (12) is adapted to indicate to the user the presence of every pot of the number of pots on their associated cooking zones (4, 6, 8, 10) and to indicate to the user the actually selected cooking zone (4, 6, 8, 10) whose at least one operating parameter is adjustable through the user interface (12) by the user, wherein in one operation mode the control unit (30) is adapted to cause a selection of a certain cooking zone (4, 6, 8, 10) and to provide a corresponding indication on the user interface (12) that the certain cooking zone (4, 6, 8, 10) is from now on selected, when a corresponding signal from the pot detection unit (28) was received by the control unit (30) that a temporal interruption of a presence of a pot on the certain cooking zone (4, 6, 8, 10) was detected, and wherein the control unit (30) is adapted to automatically copy a setting of the at least one operating parameter of a selected cooking zone (4, 6, 8, 10) to another cooking zone (4, 6, 8, 10) when the pot detection unit (28) detects a non-presence of a formerly detected pot on the selected cooking zone (4, 6, 8, 10) followed by a presence of said pot on the another cooking zone (4, 6, 8, 10) within a predetermined period of time and gives a corresponding signal to the control unit (30).

2. Hob (2) according to claim 1, wherein the temporal interruption comprises a duration of 1 to 10 seconds.

3. Hob (2) according to claim 1, wherein the hob (2) is an induction hob with a cooking surface (3) comprising a working area with a full-area heating surface.

4. Hob (2) according to claim 1, wherein the user interface (12) comprises a number of visual indication elements (A, B, C, D) to indicate at least the actually selected cooking zone (4, 6, 8, 10).

5. Hob (2) according to claim 1, wherein the user interface (12) comprises a number of confirmation elements (18, 20, 22, 24) corresponding to cooking zones (4, 6, 8, 10) through which a user can confirm the selection of a cooking zone (4, 6, 8, 10) and its release for adjustment of the at least one operating parameter.

6. Hob (2) according to claim 1, wherein an operating element (16, 17) of the user interface (12) for adjusting the at least one operating parameter of the selected cooking zone (4, 6, 8, 10) remains adjustable through the user interface (12) as long as the control unit (30) does not receive another command by a user through the user interface (12) or a corresponding signal from the pot detection unit (28).

7. Hob (2) according to claim 1, wherein the control unit (30) is adapted to copy the setting of the operating parameter only after a confirmation command of an user through the user interface (12) is given.

8. Hob (2) according to claim 1, wherein in a further operation mode the control unit (30) is adapted to assign a number of different levels of a setting of the at least one operating parameter of a selected cooking zone (4, 6, 8, 10) to a corresponding number of different cooking zones (4, 6, 8, 10) when through the pot detection unit (28) a non-presence of a formerly detected pot on the selected cooking zone (4, 6, 8, 10) followed by a presence of said pot on another cooking zone (4, 6, 8, 10) is detected within a predetermined period of time and a corresponding signal to the control unit (30) is given.

9. Hob (2) according to claim 8, wherein the control unit (30) is adapted to assign a different level of the setting of the at least one operating parameter only after a confirmation command of an user through the user interface (12) is given.

10. Hob (2) according to claim 1, wherein the predetermined period of time comprises a duration of 1 to 10 seconds.

11. Method for operating a hob (2) according to claim 1, comprising at least the following steps:

a) adjusting an operating parameter of a selected cooking zone (4, 6, 8, 10) associated to a pot through the user interface (12), b) placing the pot from the selected cooking zone (4, 6, 8, 10) to another cooking zone (4, 6, 8, 10) within a predetermined period of time, c) copying a setting of at least one operating parameter of one cooking zone (4, 6, 8, 10) associated with the pot to another cooking zone (4, 6, 8, 10), and d) confirming the copying of the setting of the at least one operating parameter to the another cooking zone (4, 6, 8, 10) by operating of a corresponding confirmation element (18, 20, 22, 24) by the user interface (12).

12. Method according to claim 11 comprising the further steps d) moving the pot from the another cooking zone (4, 6, 8, 10) to the originally selected cooking zone (4, 6, 8, 10), e) adding a further pot to the another cooking zone (4, 6, 8, 10).

13. Method for operating a hob (2) according to claim 1, comprising at least the following steps:

a) assigning a number of different levels of a setting of an operating parameter of a cooking zone (4, 6, 8, 10) to a corresponding number of different cooking zones (4, 6, 8, 10), b) selecting an operation mode which allows to assign different levels of a setting of an operating parameter of a cooking zone (4, 6, 8, 10) to different cooking zones (4, 6, 8, 10) of the hob (2) through the user interface (12), c) adjusting an operating parameter of a selected cooking zone (4, 6, 8, 10) associated to a pot through the user interface (12), d) placing the pot from the selected cooking zone (4, 6, 8, 10) to another cooking zone (4, 6, 8, 10) within a predetermined period of time, and e) confirming the assigning a different level of the setting of the operating parameter to the another cooking zone (4, 6, 8, 10) by operating of a corresponding confirmation element (18, 20, 22, 24) of the user interface (12).

14. Method according to claim 13 comprising the further step e) repeating of steps c) and d) of claim 13 to assign one further or more cooking zones (4, 6, 8, 10) another different level of the setting of the operating parameter of the original cooking zone (4, 6, 8, 10).

* * * * *